US007989700B2

(12) United States Patent
Eshima

(10) Patent No.: US 7,989,700 B2
(45) Date of Patent: Aug. 2, 2011

(54) CABLE

(75) Inventor: Hirotaka Eshima, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 112 days.

(21) Appl. No.: 12/453,769

(22) Filed: May 21, 2009

(65) Prior Publication Data

US 2010/0116541 A1 May 13, 2010

(30) Foreign Application Priority Data

Nov. 10, 2008 (JP) ..... 2008-287381

(51) Int. Cl.
*H01B 7/00* (2006.01)

(52) U.S. Cl. ..... 174/103

(58) Field of Classification Search ..... 174/102 R, 174/103, 105
See application file for complete search history.

(56) References Cited

U.S. PATENT DOCUMENTS

| | | | | |
|---|---|---|---|---|
| 2,313,234 | A * | 3/1943 | Lester | 174/120 SR |
| 4,639,545 | A * | 1/1987 | Pithouse et al. | 174/36 |
| 5,510,578 | A * | 4/1996 | Dunlavy | 174/128.1 |
| 7,164,078 | B2 * | 1/2007 | Grogl et al. | 174/36 |
| 2004/0007308 | A1 * | 1/2004 | Houston et al. | 156/54 |
| 2005/0154132 | A1 * | 7/2005 | Hakuta et al. | 525/105 |

FOREIGN PATENT DOCUMENTS

| | | |
|---|---|---|
| JP | 2006-31954 | 2/2006 |

* cited by examiner

*Primary Examiner* — Chau N Nguyen
(74) *Attorney, Agent, or Firm* — McGinn IP Law Group, PLLC

(57) ABSTRACT

A cable has a core made of an insulated wire, a shield layer provided at an outer periphery of the core, a reinforcing layer provided at an outer periphery of the shield layer, and a sheath provided at an outer periphery of the reinforcing layer. The insulated wire has a wire conductor and an insulating layer covering an outer periphery of the wire conductor. The shield layer is formed from tinsel-coppers. Each of the tinsel-copper has a core string and a copper foil provided around the core string. The reinforcing layer is formed by braiding fibers.

9 Claims, 5 Drawing Sheets

CABLE

The present application is based on Japanese Patent Application No. 2008-287381 filed on Nov. 10, 2008, the entire contents of which are incorporated herein by reference.

BACKGROUND OF THE INVENTION

1. Field of the Invention

The present invention relates to a cable, in more particular, to a cable in which a shield is provided around an electric wire.

2. Related Art

Conventionally, a cable comprising an insulated wire comprising a center conductor and an insulation for covering the center conductor, a shield layer provided at an outer periphery of the insulated wire, in which the shield layer is formed by braiding collected wires, each of the collected wires is composed of a plurality of shield wires arranged in parallel, and a friction coefficient of two shield wires provided at both sides of the collected wire is smaller than a friction coefficient of other shield wires has been known. Japanese Patent Laid-Open No. 2006-031954 (JP-A 2006-031954) discloses an example of such a conventional cable.

In the cable disclosed by JP-A 2006-031954, the friction coefficient of the shield wires provided at the both sides of the collected wire is smaller than the friction coefficient of the other shield wires. Therefore, when flexural motion is applied repeatedly to the cable in an operating environment, friction between the shield wires can be reduced, so that it is possible to provide a cable having a high flex resistance property.

However, there are following disadvantages in the conventional cable as disclosed by JP-A 2006-031954. For example, when being disposed between a body of a vehicle and a part beneath a spring of the vehicle (a lower part with respect to a suspension spring), the shield wires composing the shield layer may be broken or disconnected because of flexion (bending) due to up-and-down movement (bound and rebound) of wheels and a torsion applied at the time of steering of the wheels. Therefore, the conventional cable may be inferior in the flex resistance property, tensile strength and reliability.

SUMMARY OF THE INVENTION

Accordingly, an object of the present invention is to provide a cable which is excellent in the flex resistance property, tensile strength and reliability.

According to a feature of the invention, a cable comprises:

a core comprising an insulated wire, the insulated wire comprising a wire conductor and an insulating layer covering an outer periphery of the wire conductor;

a shield layer provided at an outer periphery of the core, the shield layer comprising a tinsel-copper comprising a core string and a copper foil provided around the core string;

a reinforcing layer provided at an outer periphery of the shield layer, the reinforcing layer comprising a braid of a fiber, and a sheath provided at an outer periphery of the reinforcing layer.

In the cable, the shield layer may comprise a braid of the tinsel copper.

In the cable, the shield layer may comprise the tinsel copper spirally wound on the outer periphery of the core.

In the cable, the tinsel copper may further comprise a plating film on a surface of the tinsel copper.

In the cable, the fiber may comprise at least one material selected from a group comprising polyvinyl alcohol, polyethylene terephthalate, and polyethylene-2,6-naphthalate.

In the cable, the sheath may comprise a rubber material including an ethylene-α-olefin-polyene copolymer comprising a polyene that is a norbornene compound containing a vinyl group at terminal, and a SiH radical-containing compound comprising a plurality of SiH radicals in one molecular.

In the cable, the sheath may comprise a rubber material comprising at least one material selected from a group comprising ethylene-propylene-diene rubber, styrene-butadiene rubber, butyl rubber, nitrile rubber, and chloroprene rubber.

ADVANTAGES OF THE INVENTION

According to the cable of the present invention, it is possible to provide a cable which is excellent in the flex resistance property, tensile strength and reliability.

BRIEF DESCRIPTION OF THE DRAWINGS

Next, the preferred embodiment according to the invention will be explained in conjunction with appended drawings, wherein.

DETAILED DESCRIPTION OF THE PREFERRED EMBODIMENT

Preferred Embodiment

Next, a preferred embodiment of the present invention will be explained in more detail in conjunction with appended drawings.

Figure 1B:
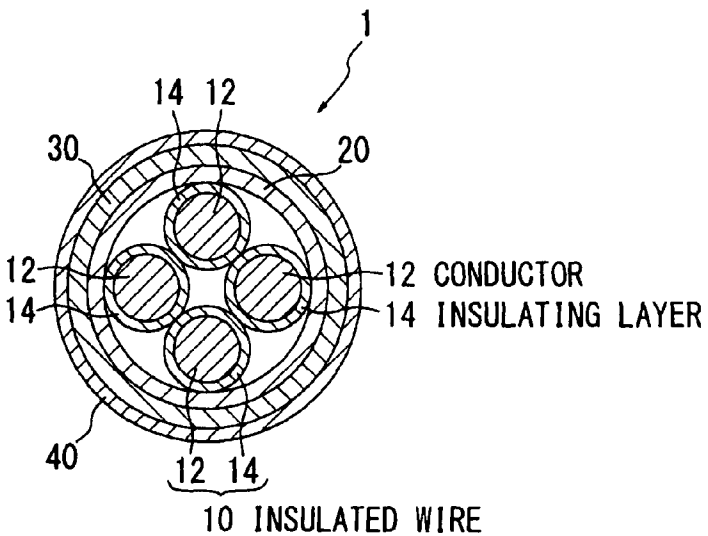
FIG. 1B is a lateral cross sectional view along A-A of the cable shown in FIG. 1A.
Figure 1A:
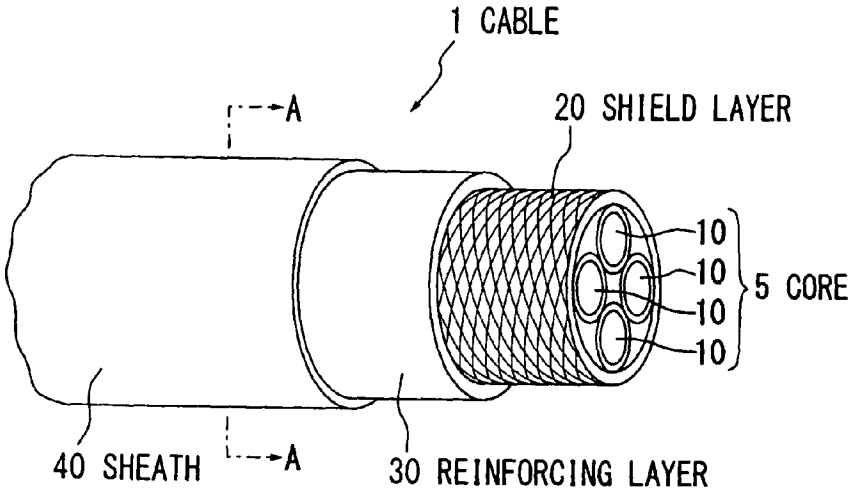
FIG. 1A is a perspective view of a cable in a preferred embodiment according to the invention.

FIG. 1A is a perspective view of a cable in a preferred embodiment according to the invention, and FIG. 1B is a lateral cross sectional view along A-A of the cable shown in FIG. 1A.

A cable 1 in the preferred embodiment comprises a core 5 comprising four pieces of insulated wire 10, the insulated wire 10 comprising a linear conductor (wire conductor) 12 and an insulating layer 14 which covers an outer periphery of the conductor 12, a shield layer 20 provided at an outer periphery of the core 5 and having a shield function, a reinforcing layer 30 provided at an outer periphery of the shield layer 20, and a sheath 40 provided at an outer periphery of the reinforcing layer 30. In FIG. 1A and FIG. 1B, the core 5 comprises four pieces of the insulated wires 10, however, the present invention is not limited thereto. The core 5 may comprise a single insulated wire 10, and may comprise two or more pieces of the insulated wires 10.

(The Conductor 12 Composing the Insulated Wire 10)

For example, the conductor 12 composing the insulated wire 10 may comprise a wire conductor comprising tinned (Sn-plated) soft copper (e.g., a conductor cross section (SQ)=3 $mm^2$). The conductor 12 may comprise a single wire conductor, or a strand wire comprising a plurality of the wire conductors stranded with each other. Further, the conductor 12 may comprise a metal wire such as a soft copper wire, a silver-plated soft copper wire, and a tinned copper alloy wire.

(The Insulating Layer 14 Composing the Insulated Wire 10)

The insulating layer 14 covering the conductor 12 may comprise, for example, a cross-linked polyethylene (XLPE) that is an insulating material and has a thickness of 0.7 mm. The insulating layer 14 may comprise a resin material such as polyethylene, foam polyethylene, cross-linked foam polyethylene, polypropylene, and fluorine resin.

(The Core 5)

The core 5 may comprise a single insulated wire 10 or a plurality of insulated wires 10. When forming the core 5 from the plurality of insulated wires 10, the core 5 may comprise a strand wire formed by stranding the plurality of insulated wires 10 into a bundle. Further, a binding layer using a tape may be provided at the outer periphery of the insulated wire 10. When forming the core 5 from the plurality of insulated wires 10, the core 5 may further comprise a filler layer having elasticity between a binding layer of one of the insulated wires 10 and binding layers of other insulated wires 10. When the filler layer is provided, it is possible to easily keep the cross section of the core 5 substantially circular. Herein, as the tape for the binding layer, a paper tape may be used. The filler layer may comprise a fiber, a resin material or the like.

According to the intended use of the cable 1, a cross sectional diameter of the insulated wire 10 and the number of the insulated wires 10 may be determined. In addition, when the core 5 comprises the plurality of insulated wires 10, it is determined according to the intended use of the cable 1 as to whether or not the plurality of insulated wires 10 should be stranded with each other.

(The Shield Layer 20)

The shield layer 20 may comprise a tinsel-copper in which a copper foil is provided around a core comprising a fiber or a string. To be concrete, the shield layer 20 comprises a braid structure formed by braiding a plurality of tinsel-coppers. Further, the shield layer 20 may have a wrap structure, in which the tinsel-coppers are spirally wound around the core 5. In the first preferred embodiment, the "fiber" has a micro filament configuration, and the "string" has a linear sequence of the fiber.

The core of the tinsel-copper may comprise the fiber or string of a polymer resin material, by way of example only, a core string comprising a polyethylene terephthalate (PET) having a diameter of ϕ 0.11 mm. The core string may comprise a single fiber or string. Alternatively, the core string may be formed by braiding a plurality of fibers or strings. The copper foil may have, for example, a thickness of 12 μm. The tinsel-copper is formed by spirally winding the copper foil around an outer periphery of the core string.

Further, the tinsel-copper may be provided with a plating film on its surface. By providing the plating film on the surface of the tinsel-copper, it is possible to prevent the surface of the copper foil from oxidation. The plating film may be formed for example by tinning. By preventing the oxidation of the surface of the copper foil, it is possible to suppress a problem, for example, an increase in resistance of the shield layer 20.

(The Reinforcing Layer 30)

The reinforcing layer 30 is formed by braiding a plurality of fibers or strings. The fiber or string may comprise, for example, a polyvinyl alcohol having a diameter of ϕ 0.1 mm. Further, it is preferable that the fiber or string comprises a material that is excellent in fatigue resistance property and abrasion resistance property. By way of example only, the fiber or string may comprise at least one material selected from a group comprising polyvinyl alcohol, polyethylene terephthalate, and polyethylene-2,6-naphthalate. The fiber or string composing the reinforcing layer 30 preferably comprises the polyvinyl alcohol.

(The Sheath 40)

The sheath 40 is provided to cover an outer periphery of the reinforcing layer 30. The sheath 40 comprises an insulating material. By way of example only, the sheath 40 may comprise a rubber material such as ethylene-propylene-diene rubber having a thickness of about 0.5 mm. Further, it is preferable that the rubber material composing the sheath 40 comprises a rubber material showing excellent heat resistance property, antiweatherability, and oil resistance property. As an example, a rubber material for a brake hose may be used.

As the rubber material for a brake hose, ethylene-α-olefin-polyene copolymer comprising a polyene, which is a norbornene compound containing a vinyl group at terminal, may be used. Further, as the rubber material, a rubber material including the ethylene-α-olefin-polyene copolymer comprising the polyene that is the norbornene compound containing the vinyl group at terminal, and a SiH radical-containing compound comprising a plurality of SiH radicals in one molecular (hereinafter, referred to as "blended rubber material") may be used. In addition, as long as the blended rubber material fulfills a function for the sheath 40, the blended rubber material may contain an agent such as reinforcing agent, filler, plasticizer, tenderizer, processing aid, activator, scorch-retarder, and age resistor appropriately. Further, the blended rubber material may be formed by blending different polymer materials.

As the rubber material, ethylene-propylene-diene rubber, styrene-butadiene rubber, butyl rubber, nitrile rubber or chloroprene rubber may be used. Namely, the rubber material may comprise at least one material selected from a group comprising ethylene-propylene-diene rubber, styrene-butadiene rubber, butyl rubber, nitrile rubber, and chloroprene rubber. In this preferred embodiment, it is preferable to use a blended rubber material that can be vulcanized under no pressure as the rubber material. Herein, the ethylene-α-olefin-polyene copolymer composing the blended rubber material is a polymer of ternary or more, which comprises ethylene, α-olefin, and polyene. As an example, the ethylene-propylene-diene rubber (EPDM) may be used.

For example, propylene, 1-butene, 4-methyl-1-pentene, 1-hexene, 1-heptene, 1-octene or the like may be used as the α-olefin. Furthermore, dicyclopentadiene, 1,4-hexadiene, 3-methyl-1,4-hexadiene, 5-methyl-1,4-hexadiene, 7-methyl-1,6-octadiene, 5-ethylidene-2-norbornene, 5-methylene-2-norbornene, 5-vinyl-2-norbornene or the like may be used as the polyene represented by dienes.

The SiH radical-containing compound composing the blended rubber material is used as a crosslinking agent for the blended rubber material. In this preferred embodiment, it is preferable to use the SiH radical-containing compound comprising at least two SiH radicals in one molecule, more preferably three SiH radicals in one molecule for the purpose of improving a degree of crosslinking. In addition, the blended rubber materials may further contain a catalyst, a reaction inhibitor or the like. As the catalyst, a catalyst for promoting hydrosilylation retroaction between the ethylene-α-olefin-polyene copolymer and the SiH radical-containing compound is used. By way of example only, a catalyst such as platinum system catalyst, palladium system catalyst, rhodium stem catalyst or the like may be used.

In addition, the reaction inhibitor may be doped appropriately to the blended rubber material for the purpose of suppressing an excessive hydrosilylation retroaction. By way of example only, benzotriazol, hydroperoxide, ethynylcyclohexanol, tetramethylethylenediamine, triarylcyanurate, acrylonitrile, acrylmaleate or the like may be used as the reaction inhibiter.

(Variations)

A cable comprising a core 5 comprising at least one insulated wire 10 to be used as a signal line for transmitting signals, a shield layer 20 provided at an outer periphery of the core 5, a reinforcing layer 30 provided at an outer periphery of the shield layer 20, and a sheath 40 provided at an outer periphery of the reinforcing layer 30 may be used as a signal cable.

Further, a cable comprising a core 5 comprising at least two insulated wires 10 to be used as electric power lines for feeding an electric power, a shield layer 20 provided at an outer periphery of the core 5, a reinforcing layer 30 provided at an outer periphery of the shield layer 20, and a sheath 40 provided at an outer periphery of the reinforcing layer 30 may be used as an electric power cable.

The signal cable and the electric power cable may be used together, for example, by juxtaposing the signal cable and the electric power cable.

Advantages of the Preferred Embodiment

The cable 1 in this preferred embodiment can be used as a cable for signal supply and/or power supply for electric and electronic components installed in a vehicle. The cable 1 used for the electric and electronic components installed in a vehicle is used in a tough environment, in which the flexion (bending) is frequent and large oscillations are applied.

The cable 1 in this preferred embodiment comprises the shield layer 20 for covering the core 5 as well as the reinforcing layer 30 provided between the shield layer 20 and the sheath 40. Therefore, even though the cable 1 is disposed between the body of the vehicle and the part beneath the spring of the vehicle, the tinsel-copper composing the shield layer 20 will not be broken or disconnected because of the flexion of the cable 1 due to the up-and-down movement of the wheels and the torsion applied to the cable 1 at the time of steering of the wheels. Therefore, the cable 1 in this preferred embodiment is superior in the shielding performance and the tensile strength, and shows excellent flex resistance property and reliability.

Further, according to the cable 1 in this preferred embodiment, it is possible to suppress the disconnection of the tinsel-coppers even in the case that a large number of flexions occur, thereby suppressing a short-circuit caused by the broken tinsel-copper which breaks through the insulating layer 14 and electrically contacts the conductor 12.

According to this structure, the cable 1 in this preferred embodiment has excellent tensile strength, heat resistance property, damage resistance property, waterproof property (antiweatherability) and oil resistance property, as well as extremely high reliability.

Example

Figure 2B:
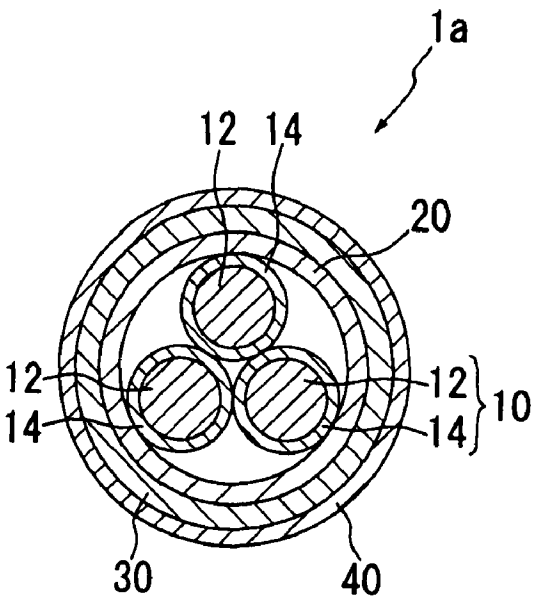
FIG. 2B is a lateral cross sectional view along B-B of the cable shown in FIG. 2A.
Figure 2A:
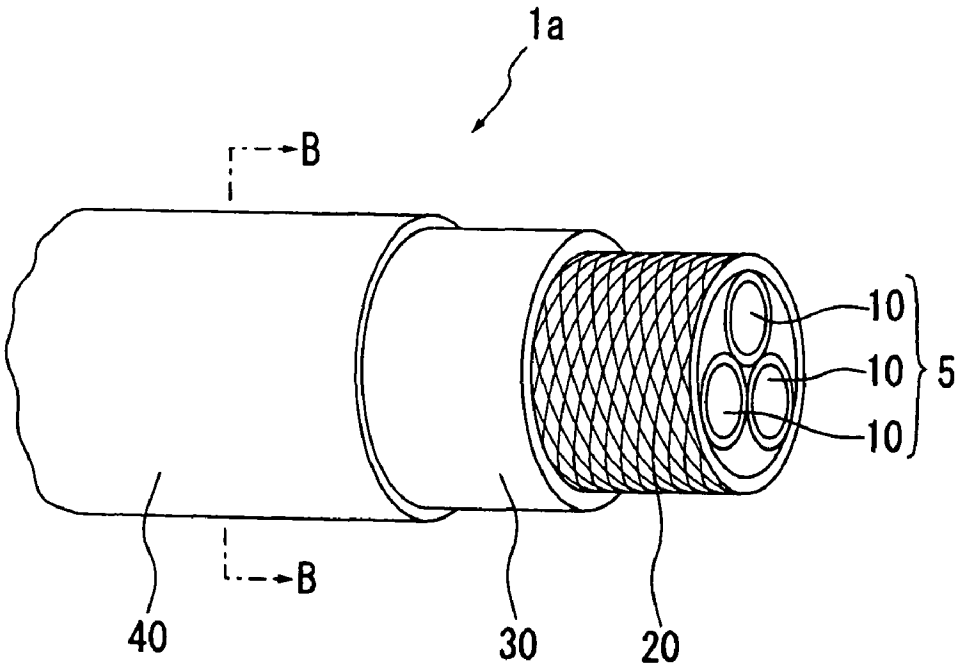
FIG. 2A is a perspective view of a cable in an Example according to the invention.

FIG. 2A is a perspective view of a cable in an Example according to the invention, and FIG. 2B is a lateral cross sectional view along B-B of the cable shown in FIG. 2A.

A cable 1*a* in the Example comprises a core 5 comprising three pieces of insulated wire 10, the insulated wire 10 comprising a linear conductor 12 and an insulating layer 14 which covers an outer periphery of the conductor 12, a shield layer 20 provided at an outer periphery of the core 5, which is formed by braiding tinsel-coppers, each of the tinsel-coppers comprising a core string comprising a fiber and a copper foil spirally wound around an outer periphery of the core string, a reinforcing layer 30 provided at an outer periphery of the shield layer 20 and having a braid structure formed by braiding a plurality of fibers, and a sheath 40 provided at an outer periphery of the reinforcing layer 30.

The conductor 12 was made by stranding 602 pieces of Sn-plated copper alloy wire having a diameter of ϕ 0.08 mm. The insulating layer 14 which covers the outer periphery of the conductor 12 was made of polytetrafluoroethylene copolymer which is a fluororesin and having a thickness of 0.5 mm. The core 5 was formed by stranding three pieces of the insulated wires 10. In the Example, a paper tape was wound around the outer periphery of the insulated wire 10 as a binding layer. Further, a filler layer comprising a fiber was provided between respective insulated wires 10, thereby providing the core 5 with a substantially circular cross section.

The shield layer 20 was formed by braiding the tinsel-coppers to have a braid structure. The tinsel-copper was formed by preparing a single string comprising PET as a core string and covering the outer periphery of the core string with a copper foil with a thickness of 12 μm. Herein, a diameter of the tinsel-copper is ϕ 0.11 mm. The reinforcing layer 30 was formed by braiding a plurality of fibers each having a diameter of ϕ 0.1 mm. The fiber was made of polyvinyl alcohol. Further, the sheath 40 was made of ethylene-propylene-diene rubber with a thickness of 0.5 mm.

Comparative Example 1

Figure 3B:
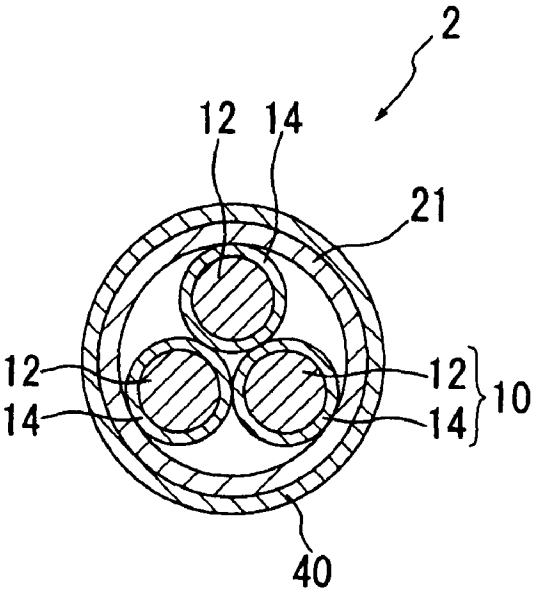
FIG. 3B is a lateral cross sectional view along C-C of the cable shown in FIG. 3A.
Figure 3A:
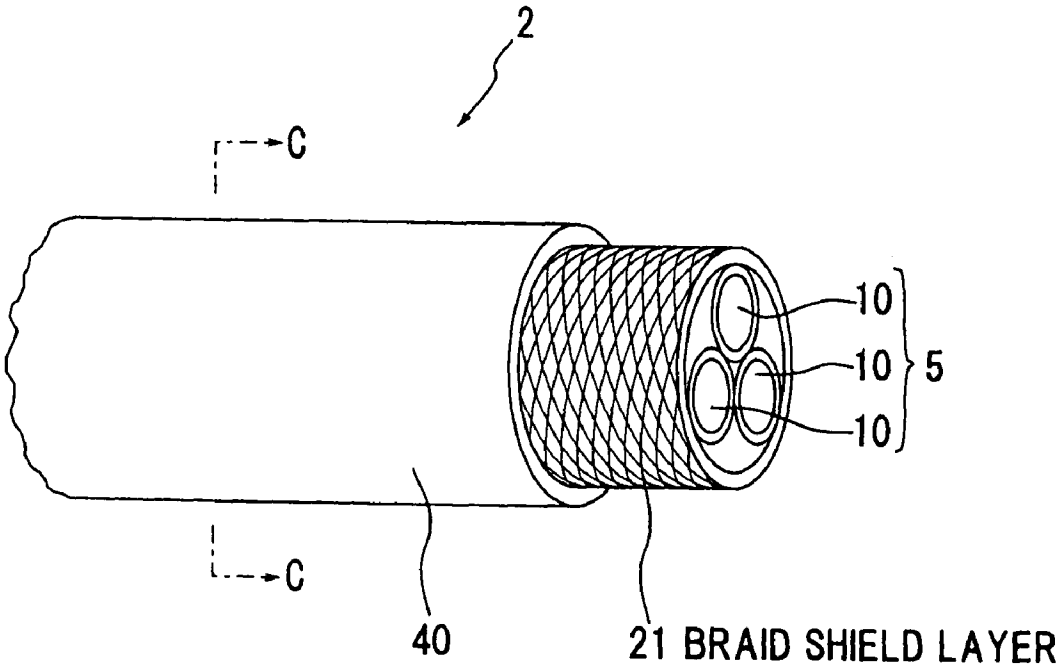
FIG. 3A is a perspective view of a cable in a Comparative example 1.

FIG. 3A is a perspective view of a cable in a Comparative example 1, and FIG. 3B is a lateral cross sectional view along C-C of the cable shown in FIG. 3A.

A cable 2 in the Comparative example 1 is similar to the cable 1*a* in the Example, except that no reinforcing layer 30 is provided and a structure of the shield layer is different. Therefore, detailed description thereof is omitted except dissimilarities.

The cable 2 comprises a core 5 comprising three pieces of insulated wire 10, the insulated wire 10 comprising a linear conductor 12 and an insulating layer 14 which covers an outer periphery of the conductor 12, a braid shield layer 21 provided at an outer periphery of the core 5, the braid shield layer 21 being formed by braiding copper wires that are metal wires, and a sheath 40 provided at an outer periphery of the braid shield layer 21.

The braid shield layer 21 was formed to have a braid structure in which the copper wires each having a diameter of ϕ 0.11 mm are braided. The sheath 40 was made of the ethylene-propylene-diene rubber to have a thickness of 0.5 mm.

Comparative Example 2

Figure 4B:
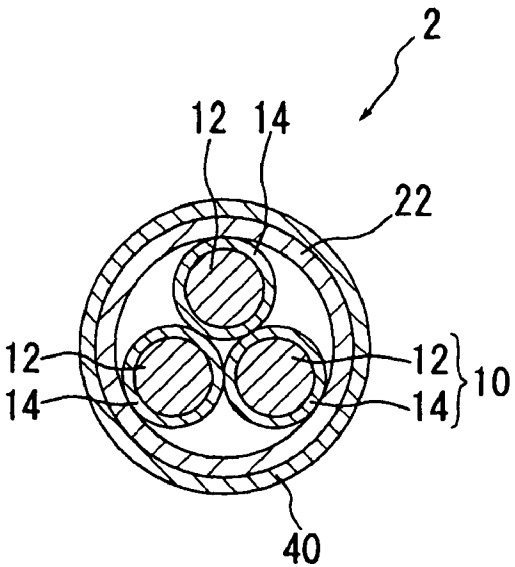
FIG. 4B is a lateral cross sectional view along D-D of the cable shown in FIG. 4A.
Figure 4A:
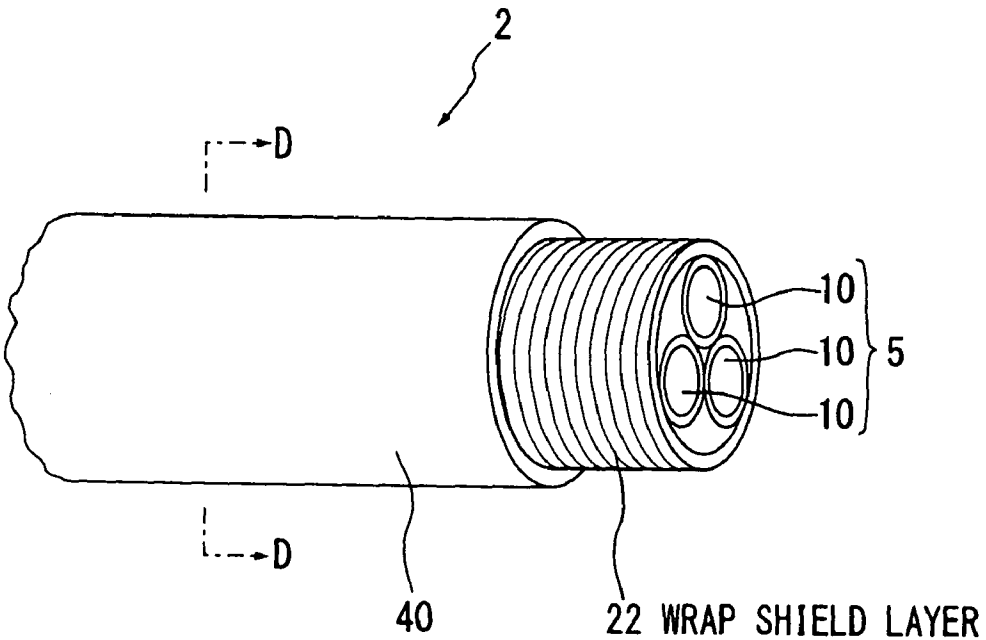
FIG. 4A is a perspective view of a cable in a Comparative example 2.

FIG. 4A is a perspective view of a cable in a Comparative example 2, and FIG. 4B is a lateral cross sectional view along D-D of the cable shown in FIG. 4A.

A cable 3 in the Comparative example 2 is similar to the cable 1*a* in the Example, except that no reinforcing layer 30 is provided and a structure of the shield layer is different. Therefore, detailed description thereof is omitted except dissimilarities.

The cable 3 comprises a core 5 comprising three pieces of insulated wire 10, the insulated wire 10 comprising a linear conductor 12 and an insulating layer 14 which covers an outer periphery of the conductor 12, a wrap shield layer (also called as "spiral shield layer" or "served shield layer") 22 provided at an outer periphery of the core 5, the wrap shield layer 22 being formed by spirally winding a copper wire around the outer periphery of the core 5, and a sheath 40 provided at an outer periphery of the wrap shield layer 22.

The wrap shield layer 22 was formed by spirally winding a copper wire or copper wires each having a diameter of ϕ 0.11 mm. The sheath 40 was made of the ethylene-propylene-diene rubber to have a thickness of 0.5 mm.

Comparative Example 3

Figure 5B:
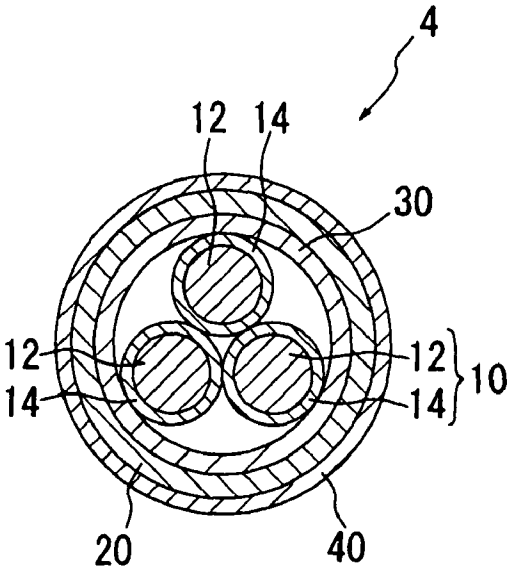
FIG. 5B is a lateral cross sectional view along E-E of the cable shown in FIG. 5A.
Figure 5A:
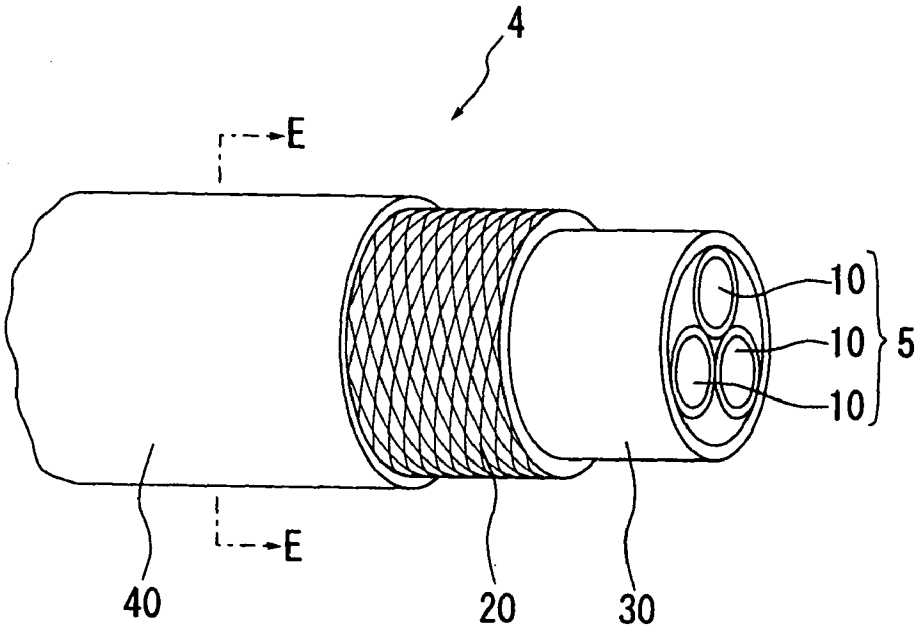
FIG. 5A is a perspective view of a cable in a Comparative example 3.

FIG. 5A is a perspective view of a cable in a Comparative example 3, and FIG. 5B is a lateral cross sectional view along E-E of the cable shown in FIG. 5A.

A cable 4 in the Comparative example 3 is similar to the cable 1*a* in the Example, except that a positional relationship between the reinforcing layer 30 and the shield layer 20 is different. Therefore, detailed description thereof is omitted except dissimilarities.

A cable 4 in the Comparative example 3 comprises a core 5 comprising three pieces of insulated wire 10, the insulated wire 10 comprising a wire conductor 12 and an insulating layer 14 which covers an outer periphery of the conductor 12, a reinforcing layer 30 provided at an outer periphery of the core 5 and having a braid structure formed by braiding a plurality of fibers, a shield layer 20 provided at an outer periphery of the reinforcing layer 30, the shield layer 20 being formed by braiding tinsel-coppers, each of the tinsel-coppers comprising a core string comprising a fiber and a copper foil spirally wound around an outer periphery of the core string, and a sheath 40 provided at an outer periphery of the shield layer 20.

Comparison Between the Example and the Comparative Examples 1 to 3

Performance of the cable 1*a* in the Example was compared with performance of the cables 2 to 4 in the Comparative examples 1 to 3. The performance was compared by carrying out following evaluation tests.

(1) Flex Resistance Property Test

The cable was bent by an angle of 180° in left and right directions for plural times, a bending radius R was 30 mm (R30), and presence of disconnection of the shield layer was observed.

(2) Torsion Durability Test

Torsion of ±0.3°/mm was applied for plural times as torsional deformation, and the presence of disconnection of the shield layer was observed.

(3) Cable Tensile Property Test

A load was applied to the cable in a longitudinal direction of the cable, and the load which caused the disconnection of the cable was measured.

TABLE 1 shows a result of the evaluation tests for the respective cables in the Example and the Comparative examples 1 to 3.

TABLE 1

| | Flex resistance property test | Torsion durability test | Cable tensile property test |
|---|---|---|---|
| Example | No disconnection after flexions for 500,000 times or more | No disconnection after torsion for 500,000 times or more | 1000N or more |
| Comparative example 1 | Disconnection after flexions for 50,000 times | Disconnection after torsion for 100,000 times | 100N or less |
| Comparative example 2 | No disconnection after flexions for 500,000 times or more | Disconnection after torsion for 100,000 times | 100N or less |
| Comparative example 3 | No disconnection after flexions for 500,000 times or more | No disconnection after torsion for 500,000 times or more | 200N or less |

Referring to TABLE 1, it is confirmed that the cable 1*a* in the Example is excellent in flex durability (namely, flex resistance property), torsion durability, and tensile property. While the tensile property of the cable 1*a* in the Example was 1000N or more, the tensile property of the cable 4 in the Comparative example 3 was 200N or less. In the cable 4 in the Comparative example 3, an order of forming the shield layer 20 and the reinforcing layer 30 was reversed compared with the order of forming the shield layer 20 and the reinforcing layer 30 in the cable 1*a* in the Example 1. Therefore, the reasons of the improvement in the tensile property in the cable 1*a* in the Example are assumed as follows. In the cable 1*a* in the Example, the reinforcing layer 30 and the sheath 40 contact with each other, so that an adhesion between the reinforcing layer 30 and the sheath 40 is improved. Further, the tensile property is improved by forming the reinforcing layer 30 by braiding the tinsel-coppers.

As described above, it is confirmed that it is possible to provide the cable with excellent flex resistance property, tensile strength and reliability according to the present invention. In other words, it is possible to improve the flex resistance property, tensile strength and reliability by providing the cable 1*a* in the Example, in which the core 5 comprising the insulated wires 10 is covered with the shield layer 20, and the reinforcing layer 30 and the sheath 40 are provided in this order on the outer periphery of the shield layer 20.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A cable, comprising:

a core comprising an insulated wire, the insulated wire comprising a wire conductor and an insulating layer covering an outer periphery of the wire conductor;

a shield layer provided at an outer periphery of the core, the shield layer comprising a tinsel copper comprising a core string and a copper foil provided around the core string;

a reinforcing layer provided at an outer periphery of the shield layer, the reinforcing layer comprising a braid of a fiber; and a sheath provided at an outer periphery of the reinforcing layer, wherein the shield layer comprises a braid of the tinsel copper;

wherein the fiber comprises at least one material selected from the group consisting of polyvinyl alcohol, polyethylene terephthalate, and polyethylene-2,6-naphthalate, wherein the sheath comprises at least one rubber material selected from the group consisting of ethylene-propylene-diene rubber, styrene-butadiene rubber, butyl rubber, nitrile rubber, and chloroprene rubber, and wherein the reinforcing layer comes into contact with the sheath.

2. The cable according to claim 1, wherein the tinsel copper further comprises a plating film on a surface of the tinsel copper.

3. The cable according to claim 1, wherein the cable has a flex resistance property of no disconnection after flexions for 500,000 or more times by a predetermined flex resistance property test, a torsion durability of no disconnection after torsion for 500,000 or more times by a predetermined torsion durability test, and a cable tensile property of 1000 N or more by a predetermined cable tensile property test.

4. The cable according to claim 1, wherein the cable is configured to be used for at least one of signal supply and power supply for electric and electronic components installed in a vehicle.

5. A cable, comprising:

a core comprising three pieces of an insulated wire, the insulated wire comprising a linear conductor and an insulating layer which covers an outer periphery of the conductor;

a shield layer provided at an outer periphery of the core, which is formed by braiding tinsel coppers, each of the tinsel coppers comprising a core string comprising a fiber and a copper foil spirally wound around an outer periphery of the core string;

a reinforcing layer provided at an outer periphery of the shield layer and having a braid structure formed by braiding a plurality of fibers; and a sheath provided at an outer periphery of the reinforcing layer, wherein the conductor comprises stranded pieces of Sn-plated copper alloy wire, wherein the insulating layer, which covers the outer periphery of the conductor, comprises polytetrafluoroethylene copolymer which comprises a fluororesin, wherein the core comprises three stranded pieces of the insulated wires, wherein the shield layer comprises a braid structure formed by braiding the tinsel coppers, said each of the tinsel coppers being formed by preparing a single string comprising polyethylene terephthalate (PET) as a core string and covering an outer periphery of the core string with a copper foil, wherein the reinforcing layer is formed by braiding a plurality of fibers, the fiber comprising polyvinyl alcohol, and wherein the sheath comprises ethylene-propylene-diene rubber.

6. The cable according to claim 1, wherein the reinforcing layer abuts the sheath.

7. The cable according to claim 6, wherein the reinforcing layer abuts the shield layer.

8. The cable according to claim 1, wherein the shield layer abuts the insulating layer of the insulated wire.

9. The cable according to claim 1, wherein the fiber comprises polyvinyl alcohol.

* * * * *